United States Patent [19]

Hayashi et al.

[11] Patent Number: 4,923,411

[45] Date of Patent: May 8, 1990

[54] EXTERNAL CONNECTION STRUCTURE OF ELECTRIC CONNECTION BOX

[75] Inventors: Hideharu Hayashi; Keiichi Ozaki; Mamoru Sawai, all of Shizuoka, Japan

[73] Assignee: Yazaki Corporation, Tokyo, Japan

[21] Appl. No.: 336,150

[22] Filed: Apr. 11, 1989

[30] Foreign Application Priority Data

Aug. 7, 1987 [JP] Japan ..... 62-120407

[51] Int. Cl.[5] ..... H01R 13/518

[52] U.S. Cl. ..... 439/540; 439/638

[58] Field of Search ..... 439/76, 540, 355, 364, 439/638–640, 715, 716, 368

[56] References Cited

U.S. PATENT DOCUMENTS

| | | | |
|---|---|---|---|
| 4,747,791 | 5/1988 | Nishio | 439/638 |
| 4,780,090 | 10/1988 | Sugiyama et al. | 439/686 |

FOREIGN PATENT DOCUMENTS

| | | | |
|---|---|---|---|
| 2102782 | 7/1971 | Fed. Rep. of Germany | 439/540 |
| 62-120407 | 8/1962 | Japan . | |
| 124447 | 7/1984 | Japan | 439/540 |
| 64-25828 | 2/1989 | Japan . | |
| 1032895 | 6/1966 | United Kingdom | 439/540 |

*Primary Examiner*—Gary F. Paumen

*Attorney, Agent, or Firm*—Armstrong, Nikaido Marmelstein Kubovcik & Murray

[57] ABSTRACT

An external connection structure of an electric connection box includes a male or a female multi-connector housing formed integral with electric connection box and connected to an internal wiring of this electric connection box, and is constituted of a through connector joined to an external wire bundle and provided with a space large enough to hold the connector housing. The other male or female multi-connector housing is joined to the above-mentioned multi-connector housing integrated with the through connector housings connected to the external wire bundle.

3 Claims, 3 Drawing Sheets

EXTERNAL CONNECTION STRUCTURE OF ELECTRIC CONNECTION BOX

BACKGROUND OF THE INVENTION

1. Field of the Invention

The present invention relates to an external connection structure of an electric connection box for routing electric wires and, more particularly to a wiring part for collectively connecting a plurality of connector housings provided on electric wires or bundles of wires such as wiring harnesses to a connector housing provided in an electric connection box, or to a connector housing to be connected separately to an external wire bundle.

2. Description of the Prior Art

In wiring for electric devices in automobiles and the like, it sometimes becomes necessary to divide one bundle of wires into a plurality of bundles for separate electric connection, so that each of the bundles is connected to a connector housing, with a part of it being connected to a connector housing provided in an electric connection box, such as a junction box and a relay box, and the other connection housing is connected to a connection housing to be connected to an external wire bundle separately from the electric connection box. FIG. 4 shows an example of a conventional external connection structure of an electric connection box. In this drawing, numeral 1′ indicates a junction box, and numeral 6′ denotes a connector housing connected to a wiring which is constituted of a bus bar and as wiring board inside the junction box. Numerals 4′ and 5′ are connector housings connected to bundles of wire harnesses branched off from a bundle of wire harness; the connector housing 5′ is connected to the connector housing 6′, while the connector housing 4′ is connected to a connector housing 8′ separate from the junction box 1′. To this connector housing 8′ is also connected a connection housing 7 branched off from the same wire harness. This is connected to a connector housing, which is not illustrated, provided below the junction box 1′ in the drawing. The connector housings 8′ and 4′ are not included in the junction box 1′ as stated above, but must be positioned near the junction box; and therefore it is called a through connector and fixedly mounted by a locking member on the side wall of the junction box.

In such an external connection structure of prior art, however, there is such a disadvantage that so many individual connections as the number of male and female connection housings are required and, in addition, the through connector is in most cases disposed in an unoccupied space in a motor vehicle. The through connector is sometimes not visible, which, therefore, will take much time in connecting the male and female connector housings and, besides, these connected state can not be confirmed.

Furthermore, there is also such a disadvantage that the through connector needs the selection of connector housings of different configurations in order to prevent incorrect insertion, and accordingly the terminal holding chamber of the connector housing often has much unused space, resulting in a poor space efficiency.

SUMMARY OF THE INVENTION

The present invention has been accomplished in an attempt to alleviate the above and other disadvantages of prior external connector structure and has an object to provide an electric connection box using a through connector connected to an external wire bundle in which a plurality of male and female connector housings can be collectively connected, thereby improving the space efficiency of the connector housings.

According to the present invention, the electric connection box has a male or female multi-connector housing which is integrated with the electric connection box and connected to an internal wiring of this electric connection box, and also is constituted of a through connector connected to an external wire bundle and provided with a space wide enough to hold the connector housing, and the other male or female multi-connector housing connected to the above-mentioned multi-connector housing is integrated with the through connector housing connected to the external wire bundle.

Other features and advantages of the present invention will become apparent from the following description of the embodiment of the present invention, together with the accompanying drawings.

BRIEF DESCRIPTION OF THE DRAWINGS

FIGS. 2A and 2B are top views of a female housing of a multielectrode connector on the electric connection box side, in which FIG. 2A shows a through connector housing not connected, and FIG. 2B shows the through connector housing connected;

DESCRIPTION OF THE PREFERRED EMBODIMENT

Figure 2A:
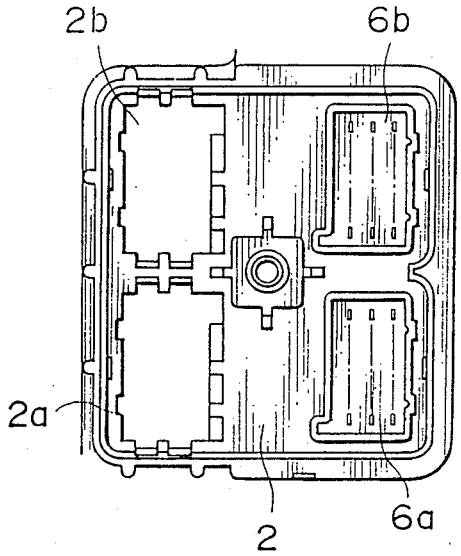
Figure 2B:
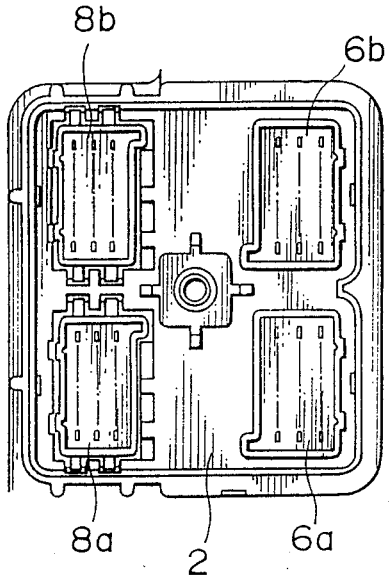
Figure 3:
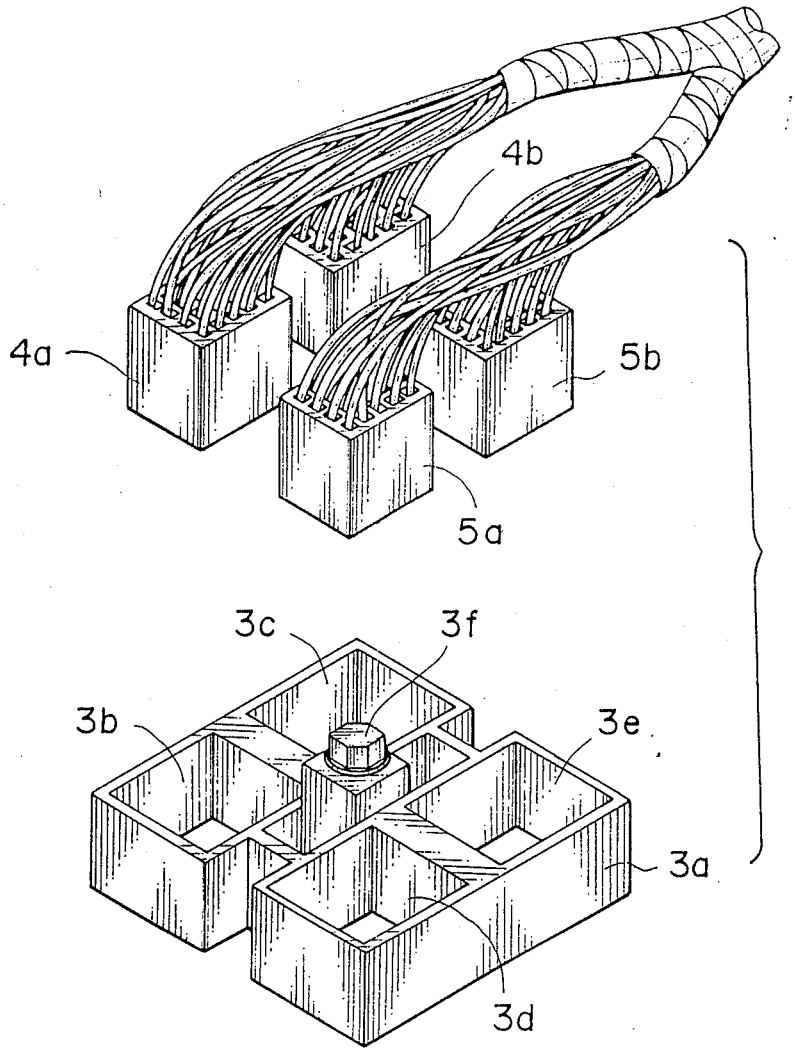
FIG. 3 is an exploded perspective view of a male housing of a multielectrode connector.

A preferred embodiment of the present invention will now be described with reference to FIGS. 1 to 3, in which the same reference numerals are used for corresponding component elements.

Figure 4:
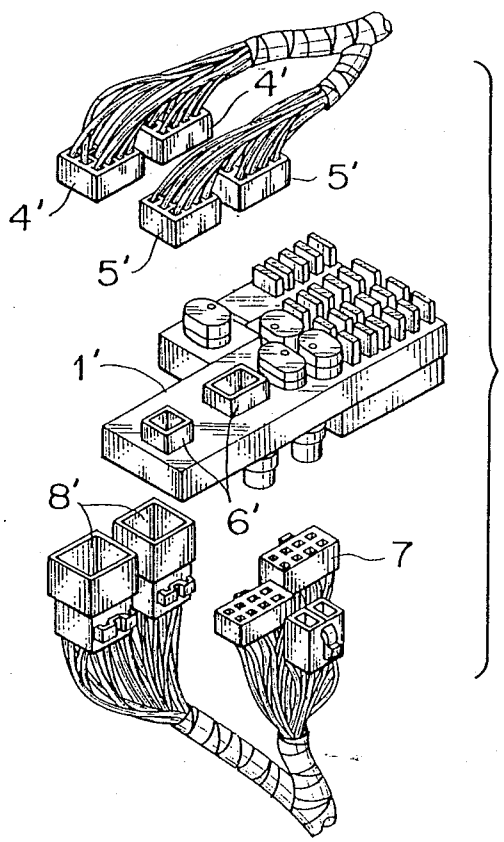
FIG. 4 PRIOR ART
FIG. 4 is an exploded perspective view of an external connection structure of an electric connection box of prior art.
Figure 1:
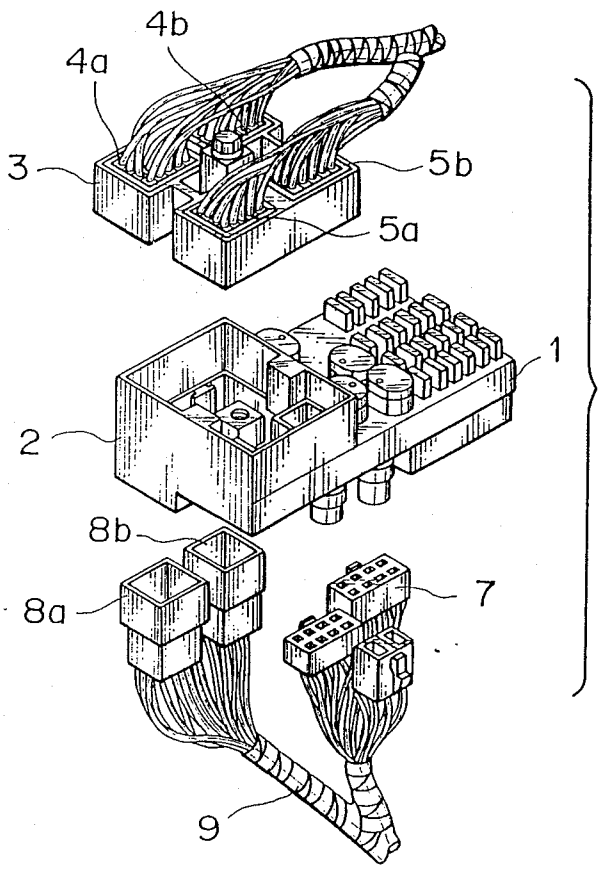
FIG. 1 is an exploded perspective view of an external connection structure of an electric connection box showing one embodiment of the present invention.

In FIG. 1, numeral 1 denotes as junction box body, or an electric connection box, which is formed integral with a female multi-connector housing 2 having an internal connector section and a through connector section. Numerals 4*a*, 4*b* and 5*a*, 5*b* are connector housings having plural electrical contacts connected to small wire bundles branched off from one bundle of wire harness. These form a multi-connector housing 3 having an internal connector section and a through connector section. The connector housings 4*a* and 4*b* are through connector housings which are not connected to the wiring within the junction box 1.

Numerals 8*a* and 8*b* indicate through connectors having plural electrical contacts connected to small wire bundles branched off from an external wire bundle 9. Numeral 7 is a connector housing having plural electrical contacts connected to a wire bundle branched off from the main bundle of a wire harness from which the above-mentioned external wire bundle 9 is branched off. In the female connector housing 2 are fixedly installed connector housings 6*a* and 6*b* of the junction box 1 and also through connector housings 8*a* and 8*b* are inserted in spaces 2*a* and 2*b*. FIG. 2A shows the through connectors not mounted, while FIG. 2B shows the through connectors in a mounted state. The connector housing 7 is connected to a connector housing not illustrated which is fixedly provided on the lower side of the connector housings 6*a*, 6*b*. The connector housing 4*a* and 4*b* received in the through connector section of the connector housing 3 are in turn received in the through connector section of the connector housing 2 are connected to the through connector housings 8*a* and 8*b* received in the through connector section of the connector housing 2, respectively. The connector housings 5*a* and 5*b* received in the internal connector section of the housing 3 are connected to the connector housings 6*a* and 6*b* in the internal connector section of the connector housing 2 of the junction box 1, respectively. Numeral 3 is a male multi-connector housing, which is connected to the female multi-connector housing 2 of the junction box 1. In a frame 3*a*, as shown in FIG. 3, holding sections 3*b* to 3*e* are formed to hold the connector housings 4*a*, 4*b* and 5*a*, 5*b*. At its center is provided a bolt 3*f* for facilitating connection.

All of the connector housings 4*a*, 4*b* and 5*a*, 5*b* can be very easily plugged together by fastening the male multi-connector housing 3 and female multi-connector housing 2 by the bolt 3*f* if only the through connector housings 8*a* and 8*b* and the connector housing 7 are matched in advance in a specific position of the female multi-connector housing 2 formed in the junction box. The through connector housings 8*a* and 8*b* and the connector housing 7, being also branched off from one bundle of wire harness, can similarly be joined by the use of multi connector housings.

According to the present invention described above, a number of connection housings can be joined quite easily, and the through connectors also can easily be connected, thus facilitating the prevention of wrong insertion and improving the space efficiency of the connector housing.

While only one embodiment of the present invention has been described, it will be apparent to those skilled in the art that various changes and modifications may be made therein without departing from the spirit and scope of the present invention as claimed.

What is claimed is:

1. An external connection structure of an electric connection box comprising:

an electric connection box having internal wiring therewithin and a first multi-connector housing formed integrally therein, said first multi-connector housing having an internal connector section connected to said internal wiring and a through connector section open therethrough;

a second multi-connector housing having an internal connector section complementary with said internal connector section of said first multi-connector housing and a through connector section complementary with said through connector section of said first multi-connector housing;

through connector housings of a first wire harness, said through connector housings of the first wire harness being received in said through connector section of the second multi-connector housing; and through connector housings of a second wire harness, said through connector housings of the second wire harness being mounted in said through connector section of the first multi-connector housing such that the through connector housings of the first wire harness are mated with the through connector housings of the second wire harness by way of the through connector section of the first multi-connector housing, wherein said internal connector section and said through connector housings of said first and second wire harnesses each have plural electrical contacts therein.

2. An external connection structure according to claim 1, wherein said first wire harness has internal connector housings adapted to be received into the internal connector section of said second multi-connector housing whereas said second wire harness has connector housings adapted to be received into the internal connector section of the first multi-connector housing.

3. An external connection structure according to claim 1, wherein said first and second multi-connector housings have means for fastening to each other.

* * * * *